United States Patent [19]

Aschberger et al.

[11] Patent Number: 4,655,050

[45] Date of Patent: Apr. 7, 1987

[54] CIRCUIT CONFIGURATION FOR CONTROLLING REFRIGERATION CIRCUITS FOR AT LEAST 2 REFRIGERATION AREAS

[75] Inventors: Matthias Aschberger; Karlheinz Färber, both of Giengen; Anton Deininger, Bachhagel, all of Fed. Rep. of Germany

[73] Assignees: The Coca-Cola Co., Atlanta, Ga.; Bosch-Siemens Hausgerate GmbH, Fed. Rep. of Germany

[21] Appl. No.: 768,364

[22] Filed: Aug. 22, 1985

[30] Foreign Application Priority Data

Aug. 22, 1984 [DE] Fed. Rep. of Germany ..... 3430946

[51] Int. Cl.[4] ..... F25B 5/00; F25D 17/02

[52] U.S. Cl. ..... 62/200; 62/139; 62/201; 62/228.2

[58] Field of Search ..... 62/199, 200, 198, 197, 62/203, 204, 208, 201, 139, 138, 228.2, 394

[56] References Cited

U.S. PATENT DOCUMENTS

| | | | |
|---|---|---|---|
| 1,523,112 | 1/1925 | Fitz Gerald | 62/201 X |
| 2,133,949 | 10/1938 | Buchanan | 62/199 |
| 3,323,681 | 6/1967 | Di Vette et al. | 62/394 |
| 3,496,733 | 2/1970 | Parker et al. | 62/139 |
| 4,497,179 | 2/1985 | Iwans | 62/139 X |
| 4,510,767 | 4/1985 | Komatsu et al. | 62/200 |

*Primary Examiner*—Harry Tanner

*Attorney, Agent, or Firm*—Birch, Stewart, Kolasch & Birch

[57] ABSTRACT

A circuit for the control of a refrigeration circuit for at least two refrigeration areas such as the carbonated water supply and beverage concentrate chamber of a beverage dispenser. Priority cooling of one area is achieved by use of a combinational logic circuit in conjunction with refrigeration-requirement sensors so that the $CO_2$ water supply will be cooled first regardless of a requirement for the cooling of the concentrate chamber.

12 Claims, 1 Drawing Figure

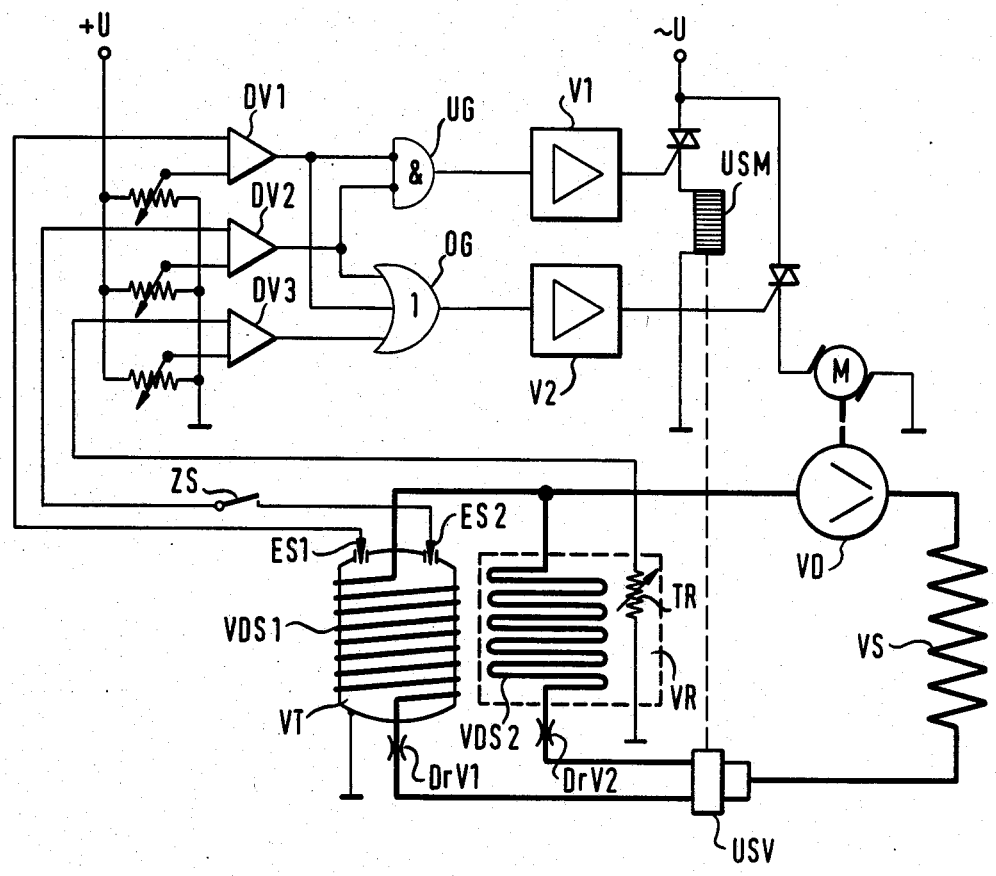
+U
~U
DV1
DV2
DV3
UG
OG
&
1
V1
V2
USM
M
ZS
ES1
ES2
VDS1
VT
VDS2
DrV1
DrV2
TR
VR
VD
VS
USV

CIRCUIT CONFIGURATION FOR CONTROLLING REFRIGERATION CIRCUITS FOR AT LEAST 2 REFRIGERATION AREAS

BACKGROUND OF THE INVENTION

This invention relates to a circuit configuration for controlling refrigeration circuits for at least two refrigeration areas, more particularly in beverage dispensers with cooling of the $CO_2$ water supply and of the beverage-concentrate room by means of one of two evaporators that can alternatively be switched into the refrigeration circuit of a condenser through a valve assembly in accordance with the refrigeration requirement measured by sensors, one of the refrigeration circuits having a higher priority for being switched into circuit.

To pressure-load a plurality of refrigeration areas, more particularly two refrigeration areas, it is common practice, e.g. in refrigerator-freezer combination units, to use a refrigeration system having one condenser and one evaporator for each of the refrigeration areas, wherein a valve system switches the evaporator section into the circuit of the condensers, as required. As a rule, compressor-condensers are employed in this connection. Preferably, the evaporators are switched into the circuit of the condenser, as required, in order to achieve maximum efficiency and to minimize the manufacturing effort. If one of the refrigeration areas is to be cooled in particular—e.g., the deep-freeze cabinet in a refrigerator-freezer combination—a priority switching as known from the prior art is carried into effect. Only after this higher-priority refrigeration area has been sufficiently subjected to the refrigeration process will the other refrigeration area be cooled.

In beverage dispensers in which a blended beverage can be provided by mixing carbonated water with beverage concentrates, it is necessary, or at least advisable, to cool the container in which the carbonated water is held in readiness or in which the water is carbonated. The cooler the water, the greater its ability to absorb $CO_2$ gas. In addition, when mixing a beverage made of a beverage concentrate and carbonated water, the part by volume of the carbonated water is a multiple of the part by volume of the beverage concentrate, so that the temperature of the carbonated water is also a determinant factor for the temperature of the blended beverage.

The cooling of the carbonated water is subject to a natural limit which is fixed by the freezing point of the mixture. To increase the refrigerating capacity, a portion of the carbonated water is stored as ice. The developing layer of ice is evaluated as a criterion for the cold production.

A temperature of the blended beverage above the desired beverage temperature can be the result of the thermal capacity of the non-refrigerated beverage concentrates and of other disturbing factors during mixing and dispensing. Therefore, in order to provide proper storage conditions for the beverage concentrates, it may be necessary also to cool the storage room for the beverage concentrates. On the other hand, it is also desirable to maximize the "cold capacity" by forming a layer of ice as thick as possible as a precautionary measure if a relatively high beverage-dispensing requirement is expected.

SUMMARY OF THE INVENTION

The object of the invention is to provide a circuit configuration for controlling refrigeration circuits for at least two refrigeration areas, more particularly for the field of application described above, said circuit configuration being capable of coping—via a common refrigeration system—with the differing requirements with regard to the cooling energy for both refrigeration areas.

According to the invention, a circuit configuration for a refrigeration circuit having a condenser and a plurality of evaporators that can be connected thereto by means of a valve assembly is characterized by the fact that sensors are assigned to at least one of the refrigeration areas for at least two refrigeration-requirement criteria and to at least one other refrigeration area for at least one refrigeration-requirement criterion, and that by means of a combinational logic circuit connected in series with the sensors, the sensors with different priorities are so assigned that the priority of the refrigeration-requirement criteria alternates between the refrigeration areas.

A circuit designed according to these novel criteria for controlling refrigeration circuits is very suitable for use in beverage dispensers with a separate stockpiling of carbonated water and beverage concentrates in that the cooling of the water supply down to a specified normal temperature takes precedence over the cooling of the storage rooms for the beverage concentrates. However, if the water supply is to be subjected to additional cooling—for example, if provisions are to be made for the dispensing of a larger amount of carbonated water, which is replaced by warmer fresh water—this cold requirement has a lower priority than the cooling of the storage room for the beverage concentrates.

According to a preferred embodiment, the novel circuit configuration when used in beverage dispensers is characterized by the fact that the sensors for providing the cold-requirement criteria for the carbonated water are electrodes in areas of the developing layer of ice at various distances from the refrigeration equipment. The electrode used to measure the cold requirement with the highest priority within the beverage dispenser is disposed in an area where the developing layer of ice exhibits a specified minimum thickness. The second electrode measures a thicker layer of ice. However, irrespective of the thickness of the layer of ice formed, the temperature of the carbonating tower is substantially the same, around or just above the freezing point.

Advantageously, to measure the refrigeration requirement in the storage room for the beverage concentrates, a circuit element that can be evaluated electronically, e.g., an NTC circuit element, is employed. Preferably, a circuit configuration designed according to the novel features is laid out such that via an OR-operation all sensors for supplying the refrigeration-requirement criteria are interconnected and can therefore be evaluated to evaluate the refrigeration circuit. A priority is to be assigned to the individual refrigeration-requirement criteria by means of another combinational logic circuit to which are routed the signals from the thermal-requirement sensors, so that the output signal of said other combinational logic circuit will trigger the restrictor valve for the refrigeration circuit. If the circuit is designed so that the restrictor valve takes a preferred position, the technical effort for designing said other combintional logic circuit can be reduced. If this preferred position is, for example, assigned to the refrigeration area from which the refrigeration-requirement criterion for the lowest priority can also be measured for the refrigeration area, the measurement of this criterion in said other combinational logic circuit can be dispensed with.

An example of operation designed in accordance with the features of the invention will now be described in detail with reference to the accompanying drawing.

BRIEF DESCRIPTION OF THE DRAWINGS

The FIGURE depicts schematically a circuit designed for use in a beverage dispenser for the cooling, on the one hand, of the carbonated water and, on the other, of the storage room for the beverage concentrates.

DESCRIPTION OF THE PREFERRED EMBODIMENT

The refrigeration circuit for the beverage dispenser essentially consists of a compressor VD driven by a motor M, a condenser section VS, a restrictor valve USV that can be triggered by means of a changeover solenoid USM, and two evaporator sections VDS1 and VDS2 with associated throttle valves DrV1 and DrV2 for, respectively, the storage tank VT for storing the $CO_2$ water supply and for the storage room VR for the beverage concentrates. Sensors ES1 and ES2 for monitoring the formation of the ice layer in the $CO_2$ water supply are placed in the storge tank VT. The differing resistances of the liquid state or of the state of the ice between particular sensors and the tank wall of the storage tank VT are evaluated by means of these sensors ES1 and ES2 and routed as control criterion to the differential amplifiers DV1 and DV2. A temperature-dependent variable resistor TR is used to measure the refrigeration-requirement criteria in the storage room VR for the beverage concentrates, said variable resistor TR being assigned to the differential amplifier DV3.

The sensor ES2 can be connected only as required into the circuit by means of a switch ZS. During normal operation of the beverage dispenser, only the sensors ES1 and TR supply refrigeration-requirement criteria to the evaluation circuit. However, if a thicker layer of ice is to be formed in the storage tank VT for the carbonated water, the sensor ES2 shall also be connected to the evaluation circuit by means of the switch ZS.

The outputs of all differential amplifiers DV1, DV3 and DV2 are interconnected by an OR logic circuit OG and trigger the motor M for the refrigerant compressor VD by means of an amplifier stage V2 and a power amplifier. As a result, the refrigeration system begins to operate regardless of which of the sensors signals a refrigeration requirement.

In addition, the outputs of the differential amplifiers DV1 and DV2 are fed to an AND logic circuit UG, whose output triggers the changeover solenoid USM for the refrigerant restrictor valve USV by means of an amplifier circuit V1 and a power amplifier. The output signal of the DIN differential amplifier DV1 is fed to the output of the AND logic circuit UG after inversion. The refrigerant restrictor valve USV preferably assumes the output position in which the refrigeration circuit is routed via the evaporator section VDS1 of the storage tank VT for the carbonated water.

If a refrigeration requirement is signaled by the sensor ES1, the AND logic circuit UG is disabled by means of the inverted signal fed thereto, regardless of whether or not there is a thermal-requirement criterion from the sensor TR of the storage room VR for the beverage concentrates. The refrigeration circuit is routed with a high degree of certainty via the evaporator section VDS1. If no refrigeration-requirement criterion is provided by the sensor ES1, the AND logic circuit UG is enabled by the inverted signal. If a refrigeration-requirement criterion from sensor TR is then present for the beverage concentrate storage room VR, this criterion will be passed on and the changeover solenoid USM will be energized by the amplifier V1 and the power amplifier, thereby reversing the position of the refrigerant restrictor valve USV while the requirement signal from TR activates motor M. Thus, the evaporator section VDS2 is activated and the storage room VR for the beverage concentrates cooled. However, if a refrigeration-requirement criterion is not provided by the sensor TR, motor M will remain OFF, and the refrigerant restrictor valve USV will resume its initial position upon reception of a requirement signal from ES1. If the switch ZS is closed, a refrigeration-requirement criterion from sensor ES2 will only be evaluated with the object of triggering the refrigerant compressor VD by means of its motor M, so that refrigerant will again be fed to the evaporator section VDS1.

In practice, the circuit referred to in the example of operation will become part of a composite circuit for the operation of a beverage dispenser. It then becomes conceivable and advisable to use a microprocessor circuit instead of discrete circuit elements for carrying out the control logic.

We claim:

1. A circuit configuration for the control of refrigeration circuits for at least two refrigeration areas, more particularly with cooling of a $CO_2$ water supply and of a beverage concentrate chamber in a beverage dispenser by means of one of two evaporators that can be alternatively switched into the refrigeration circuit of a condenser through a valve assembly in accordance with a refrigeration requirement measured by sensors, one of said refrigeration areas having a higher priority for being connected into circuit, comprising:

sensors assigned to said one of the refrigeration areas for sensing at least two refrigeration-requirement criteria, and to another refrigeration area for sensing at least one refrigeration-requirement criterion; and combinational logic circuit means connected in series with the sensors, the sensors with different priorities being connected in such a way that the priority of the refrigeration-requirement criteria alternates between said refrigeration areas.

2. A circuit configuration according to claim 1 for a beverage dispenser, wherein the sensors for the at least two refrigeration-requirement criteria are electrodes placed in the area of a developing layer of ice in the carbonated water supply at various distances from the refrigeration system.

3. A circuit configuration according to claim 1, wherein an NTC circuit element is provided as a sensor for said another refrigeration area.

4. A circuit configuration according to claim 1 for a beverage dispenser, wherein said combinational logic circuit is assigned to the refrigeration area for the $CO_2$ water supply for a first-priority primary refrigeration requirement, to the refrigeration area for the beverage concentrate for a second-priority refrigeration requirement and to the refrigeration area for the $CO_2$ water supply for a third-priority secondary refrigeration requirement.

5. A circuit configuration according to claim 1, characterized in that all the sensors are interconnected via an OR-operation in order to switch the refrigeration circuit into operation.

6. A circuit configuration according to claim 1, wherein another combinational logic circuit is provided, to which are routed respective signals of the sensors, the output signal of said other combinational logic circuit triggering a restrictor valve for the refrigeration circuit in accordance with the refrigeration-requirement priority measured thereby.

7. A circuit configuration according to claim 6, wherein the restrictor valve assumes a preferred position that is assigned to the refrigeration area with the highest-priority refrigeration-requirement criterion.

8. A circuit for controlling a refrigeration circuit for at least two refrigeration areas comprising:

first evaporator means for cooling a first refrigeration area of first priority;

second evaporator means for cooling a second refrigeration area of second priority;

compressor means for circulating a coolant material through said first and second evaporator means;

restrictor valve means for restricting the flow of said coolant material to said first evaporator means in a first mode, and said second evaporator means in a second mode;

first sensor means for detecting a primary refrigeration-requirement condition in said first area and providing a signal corresponding thereto;

second sensor means for detecting a secondary refrigeration-requirement condition in said first area and selectably providing a signal corresponding thereto when said second sensor means is connected in the circuit;

third sensor means for detecting a refrigeration-requirement condition in said second area and providing a signal corresponding thereto;

combinational-logic circuit means responsive to said first, second and third sensor means for activating said compressor means upon receiving a signal from any one of said sensor means, and for placing said valve means in said second mode only when no signal is provided by said first and second sensor means.

9. A circuit as claimed in claim 8, wherein said at least two refrigeration areas are associated with a carbonated beverage dispenser, said first area associated with a carbonated water supply and said second area associated with a beverage concentrate.

10. A circuit as claimed in claim 9, wherein said first and second sensor means comprise electrodes for sensing the thickness of a developing layer of ice in the carbonated water supply.

11. A circuit as claimed in claim 9, wherein said third sensor means comprises an NTC circuit element.

12. A circuit as claimed in claim 8, wherein said combinational-logic circuit means comprises, an AND gate having respective inputs connected to said first and second sensor means in an inverted manner, and an output connected to means for placing said restrictor valve means in its second mode when activated by said AND gate output; and an OR gate having respective inputs connected to all three sensor means, and an output connected to means for activating said compressor means upon actuation by said OR gate output.

* * * * *